US005328573A

United States Patent [19]

Kawasumi et al.

[11] Patent Number: 5,328,573

[45] Date of Patent: Jul. 12, 1994

[54] METHOD FOR ELECTROCHEMICALLY ROUGHENING A SURFACE OF A METAL PLATE

[75] Inventors: Seiji Kawasumi; Akio Uesugi, both of Shizuoka, Japan

[73] Assignee: Fuji Photo Film Co., Ltd., Kanagawa, Japan

[21] Appl. No.: 971,575

[22] Filed: Nov. 5, 1992

[30] Foreign Application Priority Data

Nov. 5, 1991 [JP] Japan ..... 3-315246

[51] Int. Cl.[5] ..... C25F 3/02

[52] U.S. Cl. ..... 204/129.4; 204/129.43; 204/129.75

[58] Field of Search ..... 204/129.4, 129.75, 129.43

[56] References Cited

U.S. PATENT DOCUMENTS 4,661,219 4/1987 Pliefke ..... 204/129.75

4,666,576 5/1987 Pliefke ..... 204/129.75

5,082,537 1/1992 Stroszynski et al. ..... 204/129.4 X 5,221,442 6/1993 Kawasumi et al. ..... 204/129.4

*Primary Examiner*—Donald R. Valentine

*Attorney, Agent, or Firm*—Sughrue, Mion, Zinn, Macpeak & Seas

[57] ABSTRACT

An apparatus and method for subjecting a material, such as an aluminum web, to an electrolytic roughening treatment. The apparatus includes a tank for storing an electrolytic solution, and for conveying the web through the solution. As the web is conveyed through the solution, it passes first and second electrodes, which are coupled to a power source circuit. The power source circuit generates an alternating current and applies the same to the electrodes. The circuit also includes a rectifying coil having an inductance ($L_1$), which is at least ten times greater than the inductance ($L_2$) of the load.

5 Claims, 3 Drawing Sheets

EXAMPLE

COMPARATIVE EXAMPLE

METHOD FOR ELECTROCHEMICALLY ROUGHENING A SURFACE OF A METAL PLATE

BACKGROUND OF THE INVENTION

The present invention relates to an apparatus and method for controlling an electrolytic roughening treatment of a material, such as a metal plate, and more particularly it relates to an apparatus and method of controlling the electrolytic reaction during an electrolytic roughening treatment a metal plate.

It is known to use an aluminum plate (including an aluminum alloy) as a support for a printing plate such as a support for an offset printing plate. In such cases, a suitable adhesion and a suitable amount of water between the surface of the aluminum plate and a photosensitive layer is necessary. To achieve this, the surface of the aluminum plate must be uniform and finely roughened. If the aluminum plate is not finely roughened, both the printing performance and durability of the printing plate will be highly affected. Accordingly, it is important to achieve a satisfactory roughening of the plate during the manufacture thereof.

In general, the roughening of an aluminum support of a printing plate involves the use of an alternating electrolytic etching method which, in turn, involves the use of an alternating current (e.g., a sine waveform, a square waveform, a special alternating waveform, etc.). The roughening treatment of the aluminum plate is performed by using a graphite electrode or the like disposed adjacent to the aluminum plate for applying the alternating current. The plate is usually only roughened once. As a result, the depth of pits formed by the roughening process in the plate is small over the whole surface thereof and the durability of the roughened printing plate for printing applications will deteriorate. Therefore, in order to obtain a uniformly and closely roughened aluminum plate having deep pits as compared with their diameters, a variety of methods are proposed. A first method is disclosed by Japanese Patent Laid-Open No. Sho. 53-67507, wherein a roughening method uses a current of particular waveform for an electrolytic source. Japanese Patent Laid-Open No. Sho. 54-65607 discloses another method which controls the ratio between an electrical quantity during a positive period and during a negative period at the time of alternating electrolytic roughening. Still another method is to control the waveform supplied from the electrolytic source (Japanese Patent Laid-Open No. Sho 55-25381). Finally, another method is directed to controlling the combination of current density (Japanese Patent Laid-Open No. Sho 56-29699).

Japanese Patent Examined Publication No. Sho 61-60797, discloses a uniform roughened surface as a result of supplying an alternating current to the aluminum plate, in which at least one of the positive periods and negative periods includes a rest period of 0 Volt, so that the electricity quantity of the positive period may be larger than that of the negative period.

However, when the aluminum plate is composed of an alloy, containing many ingredients (such as JIS3003 material), having an irregular yield of a small amount ingredients among the aluminum lots, it is likely to transform the roughened form and to change the printing performance.

As a method to eliminate the above and other problems, particularly when using an alternating waveform, the inventor of the present invention provides a method (assuming that $t_f$ is the positive period and $t_r$ is the negative period), of applying an alternating current between an aluminum support and an electrode. The alternating current includes periods, in which the current reaches peak levels in both the positive and negative periods $t_f$ and $t_r$, respectively, adjusted in the range of 0.1–20% of either period, thereby shortening the period it takes to reach the peak levels. This method then enables mass production and obtains a uniform roughening treatment, when using a power circuit including an inductive component larger than an inductive component of a load and a circuit to generate an alternating current by a current inverting control circuit. (Japanese Patent Laid-Open No. Hei. 3-82799).

However, in a waveform controlled by the method of Japanese Patent Laid-Open No. Hei. 3-82799, when the current direction in the load changes, large electric power is required, in which a top line having a trapezoidal form of the output waveform develops a tendency to incline upward and rightward. As a result, pits are formed in the period develop some distributing ranges.

Although the method disclosed in the publication satisfies the requirements of uniform pits, more satisfactory printing performance and more uniform pits are recently required and can be achieved using the invention as described below.

SUMMARY OF THE INVENTION

Accordingly, it is an object of this invention is to provide a method of electrolytic treatment for roughening a metal plate, in which a metal plate is more uniformly roughened wherein the method does not consume large amounts of electric power.

The above and other objects of the present invention are accomplished by providing an apparatus for subjecting a material to an electrolytic roughening treatment, including a tank for storing an electrolytic solution, a load comprising a transformer whose primary winding has a first inductance (L2), and first and second electrodes disposed in the tank, the first and second electrodes each have at least a surface in contact with the electrolytic solution, means for conveying the material through the electrolytic solution and adjacent to the first and second electrodes, a power source circuit, having first and second output terminals respectively coupled to the first and second electrodes. The power source circuit includes means for generating an alternating current, means for supplying the alternating current to the first and second output terminals, and a rectifying coil with an inductance (L1) that is at least ten times greater than the first inductance (L2).

DETAILED DESCRIPTION OF A PREFERRED EMBODIMENT

The present invention will now be described in detail with reference to the accompanying drawings.

Figure 1:
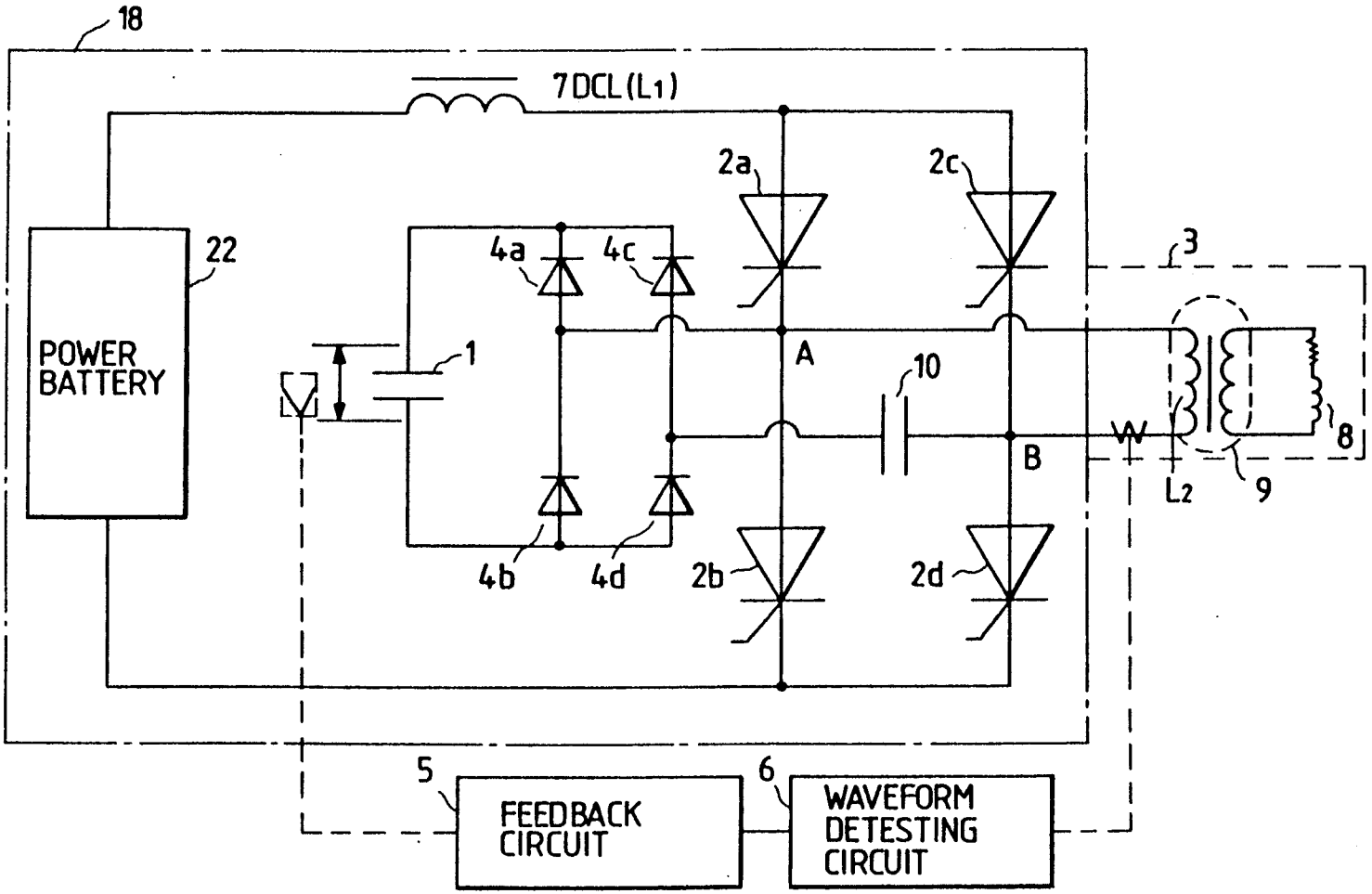
FIG. 1 illustrates a power source circuit according to the present invention.

Referring to FIG. 1, there is shown a power source circuit including a DC power source 22. A first tap of the DC power source 22 is coupled to an end of a rectifying coil 7 having a predetermined inductance (L1). The other end of the rectifying coil 7 is coupled to a pair of inverting elements 2*a* and 2*c*. Each of the inverting elements 2*a* and 2*d* are respectively coupled to a second pair of inverting elements 2*c* and 2*b*. The inverting elements 2*a*, 2*b*, 2*c*, and 2*d* are used as a gate-turn-off (GTO) thyrister, however, the present invention is not to be limited to these inverting elements as there are many other elements which can be used to perform this function.

With further reference to FIG. 1, the inverting elements are positioned so as to construct a bridge circuit wherein a first pair of the inverting elements 2*a*, 2*d* are coupled at position A, which forms a first output terminal of the power circuit, and a second pair of the inverting elements 2*c*, 2*b* are coupled at a position B to form the second output terminal of the power circuit. The outputs terminals A and B are connected to a bridge circuit of diodes 4*a*, 4*b*, 4*c*, and 4*d*, through a capacitor 1 and a capacitor 10 for supplying an electric charge in series. The capacitor 1 is also coupled to a feedback circuit 5 which is coupled to a waveform detecting circuit 6 of a load 3.

The output terminals A and B are also connected to the load 3, which includes a transformer wherein a primary winding of the transformer has an inductance of $L_2$. The inductance $L_2$ is converted from an inductance $L_2$, of the load 3 through the transformer 9, thereby reducing the period of reaching to peak current value at a positive electrode and a negative electrode. The inductance $L_1$ of the rectifying coil 7 is at least 10 times the values of the inductance of the load $L_2$.

In operation, an alternating current is generated at the output terminals A and B of the bridge circuit by turning on and off the pair of inverting elements through the gate signal, which is generated by the diodes 4*a*–4*d*.

Figure 2:
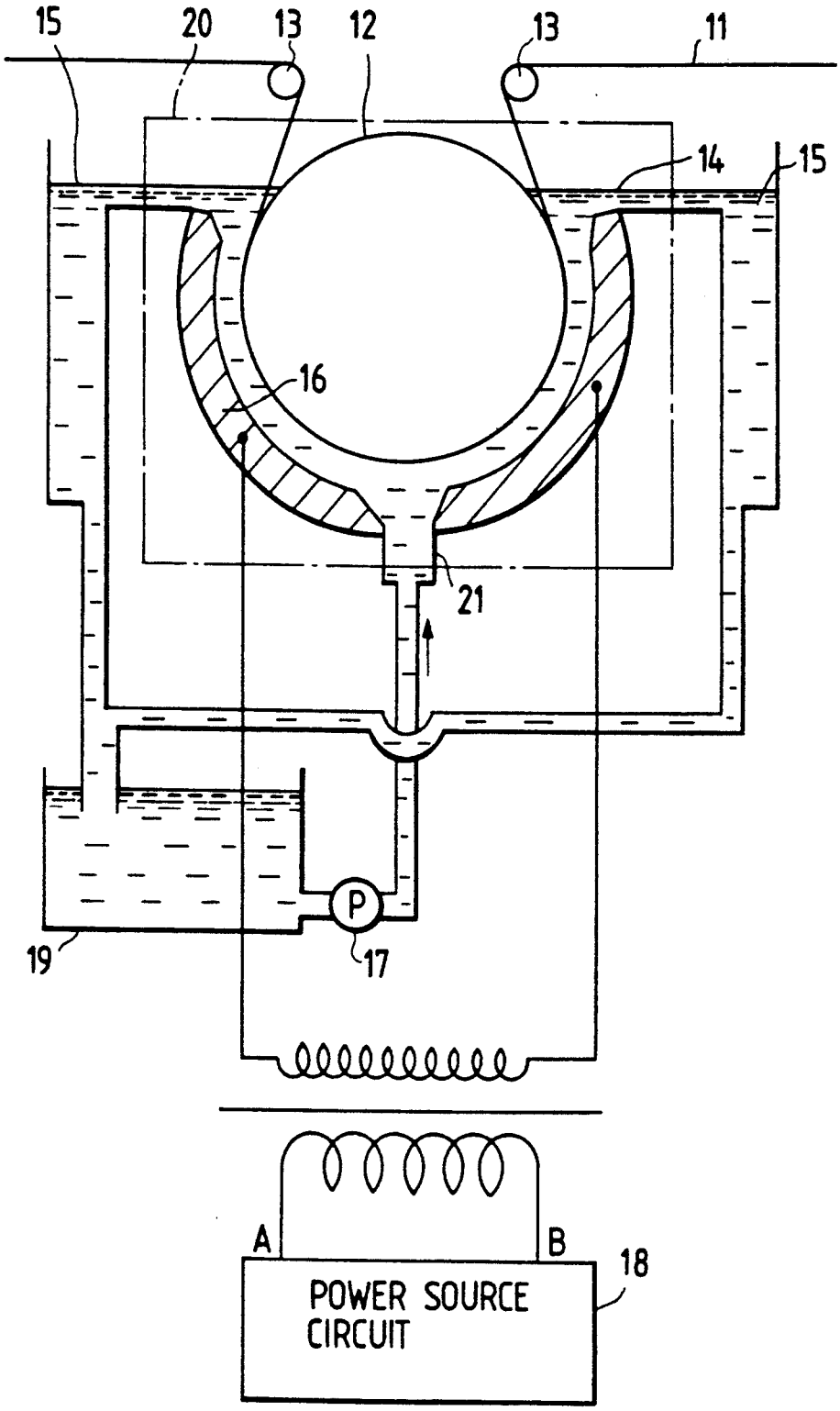
FIG. 2 illustrates an electrolytic treating tank including the power source circuit of FIG. 1 for performing an example of the method of the present invention.

FIG. 2 shows an electrolytic treatment apparatus for electrolytically treating a subject material, such as an aluminum web 11. The aluminum web 11 is conveyed via a first guide roller 13 along a supporting dram 12 to a second guide roller 13. The supporting dram 12 maintains a predetermined clearance between the web 11 and electrodes 16. As the web is conveyed around the supporting dram 12, it is immersed in a electrolytic solution 14 which includes primarily a nitric acid or a hydrochloric acid.

The electrolytic solution is contained in an electrolyte treating tank 20 having a stock tank 19 for storing the electrolytic solution, and a pump 17 for feeding the solution through a supplying inlet 21. The solution is returned through overflow outlets 15. The tank also includes main electrodes 16 formed of a graphite. Further, an assistant opposite electrode (not shown) is used to prevent deterioration of the main electrodes 16. The opposite electrode is connected to the output terminal of the power source circuit in parallel with the main electrodes 16. The assistant opposite electrode is made of platinum, lead, or similar material, but preferably, ferrite.

The electrolytic treating tank 20 may also include devices to measure and/or control physical characteristics of the apparatus and electrolytic solution, such as a temperature controller and filters for removing unexpected particles.

The power source circuit of FIG. 1, is coupled to the electrodes 16 and applies an alternating current thereto. As described above, the power source circuit 18 includes a rectifying coil 7 having an inductance larger than an inductance of the load 3 (i.e., main opposite electrodes 16 of the electrolytic treating tank 20 and bus line) and a current inverting control circuit to apply the alternating current from the AC side. The preferred frequency of the alternating current for roughening an aluminum support of the printing plate is larger than 15 Hz, although the frequency can be adjusted to suit the required quality.

An electrolytic solution according to the present invention is a solution including primarily nitric acid or hydrochloric acid. A preferable concentration of the nitric acid is in the range of 5–50 g/l and a preferable concentration of aluminum ion in the electrolytic solution is in the range of 2–20 g/l. On the other hand, a preferable concentration of the hydrochloric acid is in the range of 5–100 g/l and a suitable concentration of aluminum ion is in the range of 2–30 g/l. In addition, to achieve a uniform roughness, it is preferable that the electrolytic current have a density in the range of 10–80 $A/dm^2$ and the temperature of the electrolytic solution be above 30° C.

An electrolytic treating process according to the present invention will now be described. Initially, a pretreatment is performed as follows.

First, an aluminum support is etched by an alkaline. A preferable alkaline agent includes caustic soda, caustic potash, metasilicate soda, sodium carbonate, aluminate soda, gluconate soda or the like, with the concentration of the alkaline agent in the range of 0.001 to 20%.

Second, other preferred conditions require that the temperature of the etching liquid be in the range of 20° to 90° C., the etching period be in the range of 5 sec. to 5 min, and the etching amount be between 0.01 to 5 $g/m^2$.

Third, for an aluminum support containing a relatively large amount of impurities of manganese or the like, a preferable amount of etching is in the range of 0.01–1 $g/m^2$. Additionally, since foreign insoluble particles remain on the surface of the aluminum plate, a treatment may be necessary to remove such particles.

After performing a pre-treatment as described above, the aluminum plate is electrochemically roughened in an electrolytic solution by using the alternating current produced by the power source circuit 18.

An electrolytic solution used in accordance with the present invention may be composed of a solution primarily containing nitric acid with a concentration in the range of 3–150 g/l, and preferably 5–50 g/l, and a concentration of aluminum ion not larger than 50 g/l, and preferably, in the range of 2–20 g/l. Alternatively, the electrolytic solution may be composed of a solution primarily containing a concentration of hydrochloric acid in the range of 2–250 g/l, more preferably, 5–100 g/l, and a concentration of aluminum ion not larger than 50 g/l, and more preferably, in the range of 2–30 g/l. In some instances, it is possible to add an additive such as ammonium ion, however, in this case, it may be difficult to control the concentration of the solution for mass-production.

It is also preferable to supply the electric current at a current density in the range of 5–100 $A/dm^2$, and preferably in the range of 10–80 $A/dm^2$.

The above ranges are provided as an example and are not meant to limit the present invention in any manner as it is often necessary to select many various conditions in view of the desired quality, composition of the aluminum support, and the like.

EXAMPLE 1

A power source circuit 18 of FIG. 1 having an inductance of $L_1$ equal to 10 mH was used in an electrolytic treatment. The value of the inductance in the electrolytic treating tank was 10 $\mu$H, and a turn ratio (N) of the transformer winding was 5:1. Therefore, the value of the inductance $L_2$ of the load at the primary winding of the transformer was equal to 10 $\mu H \times (5)^2$ or 0.25 mH. Thus, the ratio of $L_1$ to $L_2$ equals 40 (i.e., 10/0.25).

An electrolytic solution was prepared having a density of nitric acid of 10 g/l, a density of aluminum ion in the electrolytic solution of 7 g/l, and a temperature of 55° C.

Figure 3:
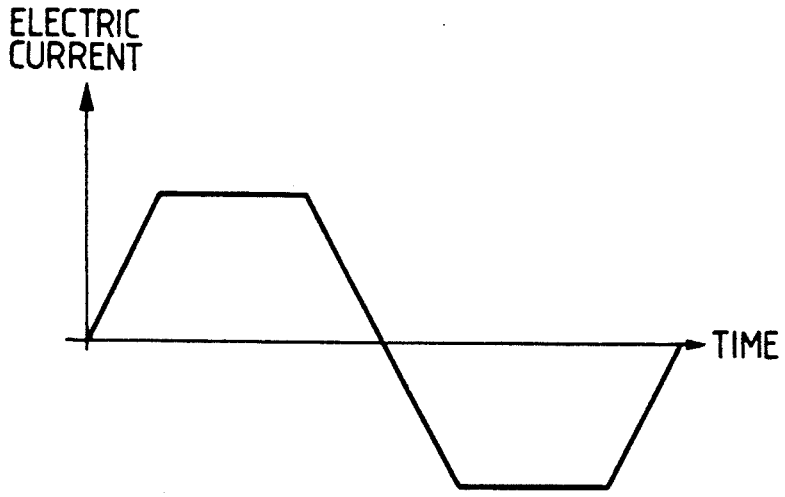
FIGS. 3 and 4 illustrate electric current waveforms in the respective electrolytic roughening treatments.

The electrolytic roughening treatment was performed with a voltage of 20 V applied to the capacitor 1 in the power source circuit 18 while supplying electric current to the electrolytic treating tank 20. Further, during the treatment, an electric quantity at the positive electrode was determined to be 300 coulomb, and the frequency of the alternating current was 40 Hz. When observing the current waveform just before the electrolytic treating tank by an oscilloscope, a top portion of the waveform was leveled and had a trapezoidal form as shown in FIG. 3. After roughening, an electron microscope was used to observe the surface where uniform pits had been formed in the plate.

COMPARATIVE EXAMPLE 1

The same electrolytic treating tank and electrolytic solution as used in Example 1 was used in this Comparative Example 1. The electrolytic roughening treatment was performed with the inductance $L_1$ equaled 1 mH of the rectifying coil 7 in the power source circuit 18. All other conditions of the Comparative Example 1 were the same as Example 1.

Accordingly, the ratio of the inductance $L_1/L_2$ equaled 4 (i.e., 1/0.25)

Figure 4:
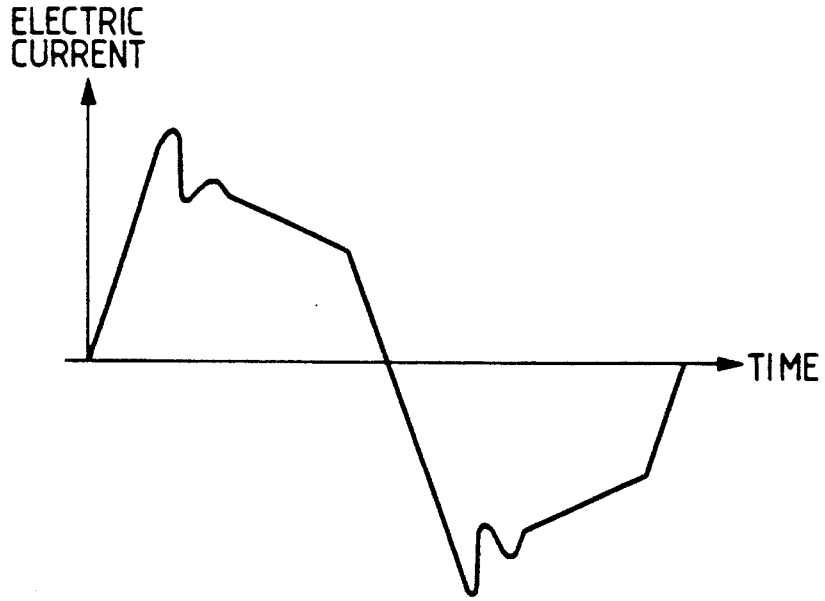

When observing the current waveform by an oscilloscope, a top portion of the waveform had been inclined and had ripples as shown in FIG. 4. After the roughening, the surface of the roughened plate was again observed and pits formed in the plate were found to be non-uniform and having depths between 10 to 20 $\mu$m.

According to the electrolytic treating method of the present invention, the top flat portion of the current waveform is leveled, and the electrolytic roughening treatment is performed on an optimum condition of the pit and on a preferable condition of power supply cost to suffer a requirement of mass-production.

There has thus been shown and described a novel apparatus and method for controlling an electrolytic treatment of a subject material which fulfills all the objects and advantages sought therefor. Many changes, modifications, variations, and other uses and applications of the subject invention will, however, become apparent to those skilled in the art after considering the specification and the accompanying drawings which disclose preferred embodiments thereof. All such changes, modifications, variations, and other uses and applications which do not depart from the spirit and scope of the invention are deemed to be covered by the invention which is limited only by the claims which follow.

What is claimed is:

1. A method for electrochemically roughening a surface of metal plate comprising the steps of:

providing the metal plate;

contacting said plate with an electrolytic solution;

applying to said plate through adjacent electrodes and said solution an alternating current generated by a power source circuit containing a rectifying coil having an inductance at least ten times greater than an inductance of a load on said power source circuit.

2. A method as defined by claim 1, wherein said electrolytic solution comprises nitric acid with a concentration in the range of 3–150 g/l; and a concentration of aluminum ion not larger than 50 g/l.

3. A method as defined by claim 2, wherein said electrolytic solution comprises nitric acid with a concentration in the range of 5–50 g/l, and a concentration of aluminum ion in the range of 2–20 g/l.

4. A method as defined by claim 1, wherein said electrolytic solution comprises hydrochloric acid in the range of 2–250 g/l; and a concentration of aluminum ion not larger than 50 g/l.

5. A method as defined by claim 4, wherein said electrolytic solution comprises hydrochloric acid in the range of 5–100 g/l; and a concentration of aluminum ion in the range of 2–30 g/l.

* * * * *